US010021930B2

(12) United States Patent
De Jesu

(10) Patent No.: US 10,021,930 B2
(45) Date of Patent: Jul. 17, 2018

(54) NOISE REDUCING WATER RESISTANT HEADPIECE

(71) Applicant: DEEJAYZOO, LLC, New York, NY (US)

(72) Inventor: Jacquelin De Jesu, Brooklyn, NY (US)

(73) Assignee: DEEJAYZOO, LLC, New York, NY (US)

( * ) Notice: Subject to any disclaimer, the term of this patent is extended or adjusted under 35 U.S.C. 154(b) by 77 days.

(21) Appl. No.: 14/837,063

(22) Filed: Aug. 27, 2015

(65) Prior Publication Data

US 2016/0100648 A1 Apr. 14, 2016

Related U.S. Application Data

(63) Continuation-in-part of application No. 29/504,909, filed on Oct. 10, 2014, now Pat. No. Des. 775,792.

(51) Int. Cl.
*A42B 1/12* (2006.01)

(52) U.S. Cl.
CPC ..... *A42B 1/12* (2013.01)

(58) Field of Classification Search
CPC ..... A42B 1/12; A42B 1/18
USPC ..... 2/174, 68
See application file for complete search history.

(56) References Cited

U.S. PATENT DOCUMENTS 770,338 A 9/1904 Tooher
1,144,121 A 6/1915 Guinzburg
1,742,314 A 1/1930 Husman
1,798,024 A * 3/1931 McBride ..... A42B 1/12 2/68
1,929,368 A 10/1933 Snell et al.
2,229,825 A 1/1941 Stachel
2,417,323 A 3/1947 Richards et al.
2,524,463 A 10/1949 Moore
2,497,892 A 2/1950 Klar
2,647,259 A 12/1951 Hutton
2,726,398 A 12/1955 Cooper
2,730,720 A * 1/1956 Saunders ..... A42B 1/12 2/68
2,858,834 A * 11/1958 Givens ..... A45D 19/18 132/212
2,917,749 A * 12/1959 Strickhouser ..... A42B 1/12 2/68
3,009,159 A * 11/1961 Emmet ..... A42B 1/041 2/171.01
3,088,469 A 5/1963 Berryhill et al.
3,113,321 A * 12/1963 Siegel ..... A45D 8/40 2/174
3,138,801 A * 6/1964 Brodsky ..... A42B 1/12 2/174
3,447,164 A * 6/1969 Greenhouse ..... A42B 1/12 2/68
3,503,076 A * 3/1970 Marks ..... A42B 1/12 2/68

(Continued)

*Primary Examiner* — Alissa L Hoey
(74) *Attorney, Agent, or Firm* — Greenberg Traurig, LLP

(57) ABSTRACT

A covering apparatus having a unitary material. The unitary material has a grip disposed around the interior perimeter of the material. The grip is fused to the material wherein the grip enables the material to provide a water tight seal and wherein the material is covering an object without slipping and sliding off the object. The material has an elastic member which is enclosed in the material which is located in the rear of the covering apparatus.

7 Claims, 13 Drawing Sheets

(56) References Cited

U.S. PATENT DOCUMENTS 3,510,880 A * 5/1970 Horst ..... A42B 1/12 2/68
3,561,455 A * 2/1971 Gregg ..... A45D 8/40 132/274
3,750,681 A * 8/1973 Claunch ..... A45D 8/40 132/274
3,996,621 A * 12/1976 Martienssen ..... A42B 1/12 2/68
4,378,606 A * 4/1983 Snowden ..... A42B 1/041 2/200.1
4,400,830 A 8/1983 Gaitan
4,660,229 A * 4/1987 Harris ..... A61F 11/06 128/866
5,249,308 A * 10/1993 Blume ..... A45D 20/20 2/174
5,265,278 A * 11/1993 Watanabe ..... A42B 1/04 2/174
5,365,613 A 11/1994 Henegan
D388,589 S 1/1998 Walker
6,026,822 A * 2/2000 Skiba ..... A45D 19/16 132/212
6,052,825 A * 4/2000 Dodd ..... A42B 1/12 2/181
6,088,832 A * 7/2000 Newman ..... A41D 7/00 2/238
6,189,152 B1 2/2001 Lofton
D448,917 S 10/2001 Grant
6,330,721 B1 * 12/2001 Wallace ..... A42B 1/12 2/174
6,560,784 B2 5/2003 Hill
7,011,228 B2 * 3/2006 Ordiway ..... B65D 41/22 150/154
7,051,895 B2 * 5/2006 Toussant ..... B65D 41/22 150/154
7,390,760 B1 * 6/2008 Chen ..... A61F 13/514 442/340
7,412,729 B1 8/2008 McGovern
7,614,089 B2 * 11/2009 Hillman-Schwartz . A45D 44/12 128/866
7,798,155 B2 * 9/2010 Schweers ..... A42B 1/069 132/273
7,865,974 B1 * 1/2011 Heller ..... A61F 11/06 2/209
8,061,368 B2 * 11/2011 Chudzik ..... A45D 8/36 132/273
8,316,466 B2 11/2012 Saito
8,402,926 B1 * 3/2013 Nunez ..... A01K 13/006 119/850
D756,605 S 5/2016 Taylor
D756,610 S 5/2016 Taylor
9,398,780 B1 * 7/2016 Matallana ..... A42B 1/12
D775,792 S * 1/2017 De Jesu ..... D2/867
2003/0126670 A1 * 7/2003 Graneto, III ..... A45D 19/14 2/174
2005/0050611 A1 * 3/2005 Donovan ..... A42B 1/008 2/174
2007/0056079 A1 3/2007 Didier
2009/0038048 A1 * 2/2009 Thompson ..... A42B 1/12 2/68
2009/0151046 A1 * 6/2009 Donovan ..... A42B 1/12 2/174
2010/0192273 A1 * 8/2010 Dodd ..... A63B 33/00 2/68
2013/0247269 A1 9/2013 Alburg
2013/0298929 A1 11/2013 Cole
2014/0101821 A1 * 4/2014 Dammann ..... A42B 1/12 2/171.4
2015/0000002 A1 * 1/2015 Brown ..... A42B 1/12 2/68
2015/0150327 A1 * 6/2015 Scott ..... A42B 1/12 2/68
2015/0209621 A1 * 7/2015 Cason ..... A63B 33/00 2/68
2016/0066639 A1 * 3/2016 Brown ..... A42B 1/12 2/68
2017/0042267 A1 * 2/2017 Guice ..... A42B 1/12

* cited by examiner

NOISE REDUCING WATER RESISTANT HEADPIECE

CLAIM OF PRIORITY

This application is a continuation-in-part of U.S. Design patent No. 29/504,909 filed Oct. 10, 2014, entitled Noise Reducing Water Resistant Headpiece, the contents of which are hereby incorporated by reference herein.

FIELD OF THE EMBODIMENTS

The invention and its embodiments relate to a shower cap with improved properties. In particular, a shower cap that provides a more relaxing shower experience by reducing the volume experienced by a user of said shower cap.

BACKGROUND OF THE EMBODIMENTS

Conventional head coverings and apparatuses are known in the art and date back many years. Specifically, a shower cap (also known as a bath cap) is a hat worn while showering or bathing to protect hair from becoming wet. Alternatively, shower caps for children can resemble crowns with wide brims, preventing water and shampoo from getting in a user's eyes while allowing the hair to be washed.

Many of these caps are created by merging two layers of fabric, one that is water impermeable, and one that is decorated. This allows a shower cap to retard the spread of water, all while being visually pleasing. While this two-fabric design works well, simpler designs of shower caps are made from a single layer of a waterproof material. Regardless of the amount of layers in the cap, these designs invariably contain some elastic edging, used to keep them in place.

Shower baths grew in popularity around the same time that daily bathing became ubiquitous with society. Reports show that while the authorities of the time viewed daily bathing favorably, whether or not daily hair-washing was helpful was unclear. This uncertainty spurred the creation of the "extinguisher cap," a pointy oilcloth hat worn by bathers in the Regency-era. These caps were designed to protect a bather's hair while shielding them from the new experience of water continuously falling on their heads from above.

By the 1880's the "extinguisher cap" began to disappear and the modern shower cap began to enter the folds of mainstream society. Since 1950' traditional shower cap construction stayed the same. The present invention apply lingerie and performance advancements to a space that has traditionally had no technological innovation in the last 50 plus years.

Review of Related Apparatus and Methods:

U.S. Pat. No. 8,316,466 discloses a secure-fitting and absorbent elongated hood for containing, managing, and drying wet hair and preventing water from dripping onto flooring or onto the wearer's clothing during the hair drying or hair setting process, requiring no leaning forward of the head for application. Such elongated hood generally comprises an absorbent concave form-fitting cap having a centering button located thereon, a triangular wing of fabric extending from each of the left and right sides of said form-fitting cap of said elongated hood, reciprocal hook-and-loop fabric strips sewn onto each left and right triangular wing, an elongated tail region being progressively tapered from said concave form-fitting cap to a rounded and concave distal end and having an elastic loop for fastening purposes, and concave petal-shaped protuberances of absorbent fabric at such concave distal end for catching, retaining, and absorbing water dripping from the wearer's hair.

U.S. Pat. No. 7,412,729 discloses a device that covers the head of an individual. It consists of a towel, a strip of elastic, a set of strips and a pocket. The pocket within the device allows an individual to insert his or her hair into the device. The individual then tightly twists the end of the towel with the pocket and the end of the towel with the pocket is secured with the tie strips. A piece of elastic allows some flexibility with the device to ensure that the device will fit all heads and to insure the comfort of the wearer.

U.S. Pat. No. 6,560,784 teaches a multi-layered moisture resistant hair wrap surrounds a person's entire head of hair protecting, maintaining, and prolonging a hairstyle and adapted to do so in moist environments that include water, steam, mist and humidity and absorbing moisture generated from heat or perspiration from one's scalp.

U.S. Pat. No. 6,189,152 teaches a bathing cap that includes lower extensions which can wrap around the sides of the cap, cross at the top, wrap down around the sides, and tie at the nape of the neck. Preferably, the portions of the cap adjacent the cheeks project forward of the normal hairline.

U.S. Pat. No. 5,365,613A hair drying turban made from a single piece of absorbent cloth and having a cap portion and, extending forwardly, a hair basket portion. In use, the wearer places the cap portion on his or her hair with the hair extending forwardly over the forehead and face (the wearer bending at the waist). Then, with the hair placed neatly within the hair basket portion, the hair basket is twisted about the longitudinal axis of the hair. The hair basket portion is then folded backwardly along the center line of the cap portion and secured to the back of the cap portion. A loop is provided for allowing the turban to be easily hung on a door peg and/or, alternatively, to facilitate the tucking in of the hair basket portion beneath the cap portion.

U.S. Patent Publication No. 2007/0056079 teaches a long cap for protecting the hair, of elongate form, formed from two lateral walls of parallelepipedal shape fixed to one another along one of their long sides and one of their two small sides so as to delimit a first pocket arranged at the proximal end of the long cap, forming a cap, and a second pocket arranged at the distal end of the long cap and forming a receptacle for the floating mass of hair, and whose two ends are provided with complementary fastening means that can be placed in contact in order to close the long cap around the head after the hair has been placed in the cap, turning the distal end through 180° about the longitudinal axis of the long cap and then folding this distal end down in order to cover the proximal end.

U.S. Patent Publication No. 2013/0298929 discloses a hair protection cap according to the present disclosure includes a bag forming an interior channel having an inside surface and outside surface, the interior channel having a first opening and a second opening opposite the first opening. A first opening reducing device enables the expansion and contraction of a size of a perimeter of the first opening and a second opening reducing device enables closing of the second opening. The inside surface of the bag is a pliable material and the outside surface of the bag is a pliable water-resistant material, the pliable water-resistant material extending over the perimeter of the first opening on the inside surface of the bag.

U.S. Patent Publication No. 2013/0247269 teaches a decorative swim/bath/shower tuque worn by a swimmer/bather/showerer, respectively, having voluminous hair with a length. The decorative swim/bath/shower tuque has dual lengths so as to adjust to the length of the voluminous hair of the swimmer/bather/showerer. The decorative swim/bath/shower tuque includes a sleeve, a dome, and a folded brim. The sleeve has a lower end and an upper end, and is worn by the swimmer/bather/showerer. The dome closes the upper end of the sleeve. The folded brim defines the lower end of the sleeve, and has the dual lengths so as to adjust the sleeve to the length of the voluminous hair of the swimmer/bather/showerer.

Various apparatuses and devices are known in the art. However, their structure and means of operation are substantially different from the present invention. Such traditional apparatuses and devices fail to provide a means for creating a secure grip, noise reducing and also fail to provide a fashionable silhouette. At least one embodiment of this invention is presented in the drawings below, and will be described in more detail herein.

SUMMARY OF THE EMBODIMENTS

The present invention provides for a covering apparatus having a unitary material. The unitary material adapted and configured with a grip disposed around the interior perimeter of the material. The grip is fused to the material wherein the grip enables the material to provide a water tight seal and wherein the material is covering an object without slipping and sliding off the object. The material is adapted and configured with an elastic member which is enclosed in the material which is located in the rear of the covering apparatus. In another embodiment the elastic member may not be enclosed in a material. In another embodiment, the elastic member may be located around the interior edges of the covering apparatus.

The covering apparatus further having material which enables the covering apparatus to be secured over a plurality of objects. The material is comprised of a fabric. The fabric is adapted and configured with a poly urethane backing. The material has a durable water repellent coating which is applied to the fabric. This makes the material hydrophobic and has a nanotechnology component. The grip is comprised of rubber, neoprene or any material which may provide a secure and water tight functionality. The material is adapted and configured to be water resistant. The materials is digitally sublimated with a plurality of designs. The grip is stitched, bonded or piped on to the material. The material is adapted and configured to include a plastic liner disposed on the entire inside of the material. This may mean that the plastic liner is fused to the entire inside of the material. The material is either knit or woven. The exterior of the material is multiply folded on each side wherein said folds culminate into a point. The covering apparatus may comprise a turban.

It is an object of the present invention that the covering apparatus may be used as a shower cap.

It is an object of the present invention that the covering apparatus may be used to protect the hair from coming into contact with water.

It is an object of the present invention that the covering apparatus is able to reduce the noise heard by an individual wearing the shower cap as compared to a plastic shower cap.

It is an object of the present invention that the covering apparatus may be used to cover golf clubs, surgical and sanitary hair coverings or as a fashion accessory.

It is an object of the present invention that the fabric is antibacterial and machine washable.

It is an object of the present invention that the material comprises a pocket for enclosing hair.

DESCRIPTION OF THE PREFERRED EMBODIMENTS

Figure 1:
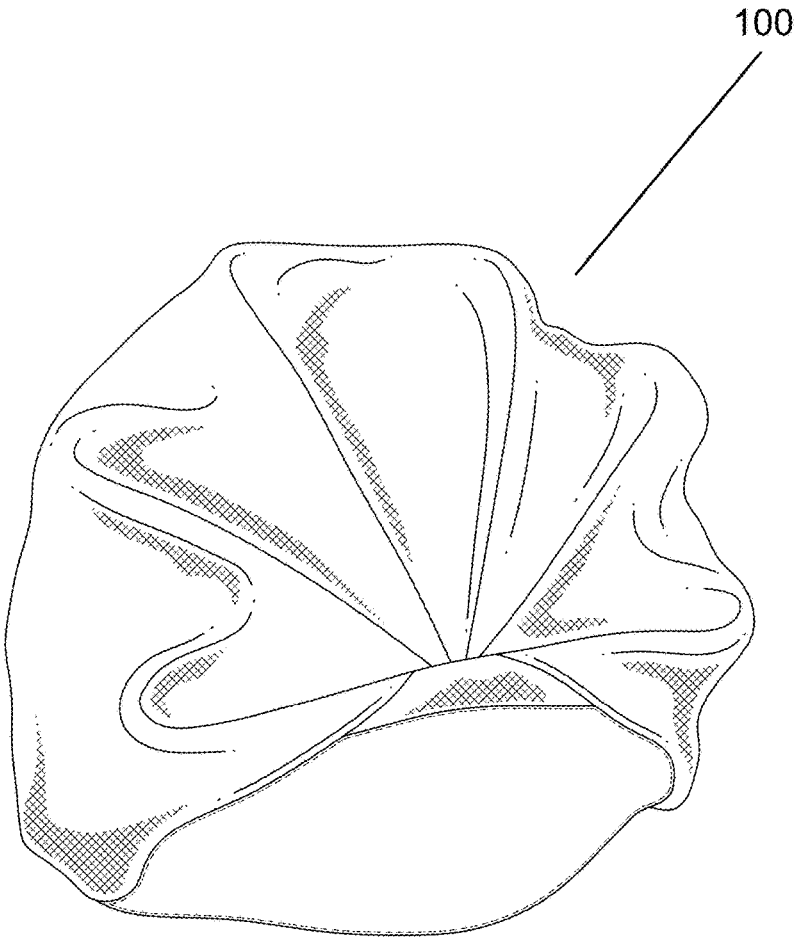
FIG. 1 is a perspective view of the present invention.
Figure 2:
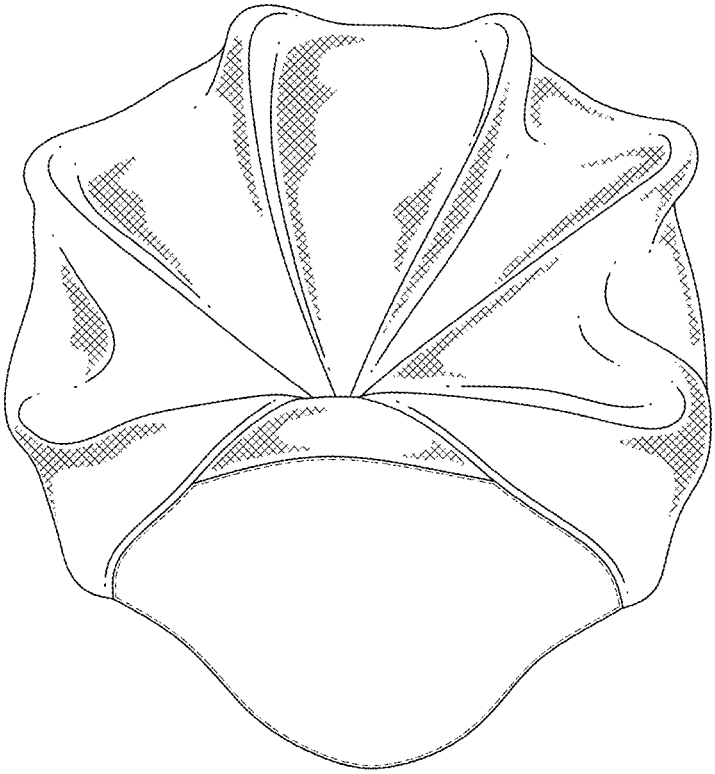
FIG. 2 is a front perspective view of the present invention.
Figure 3:
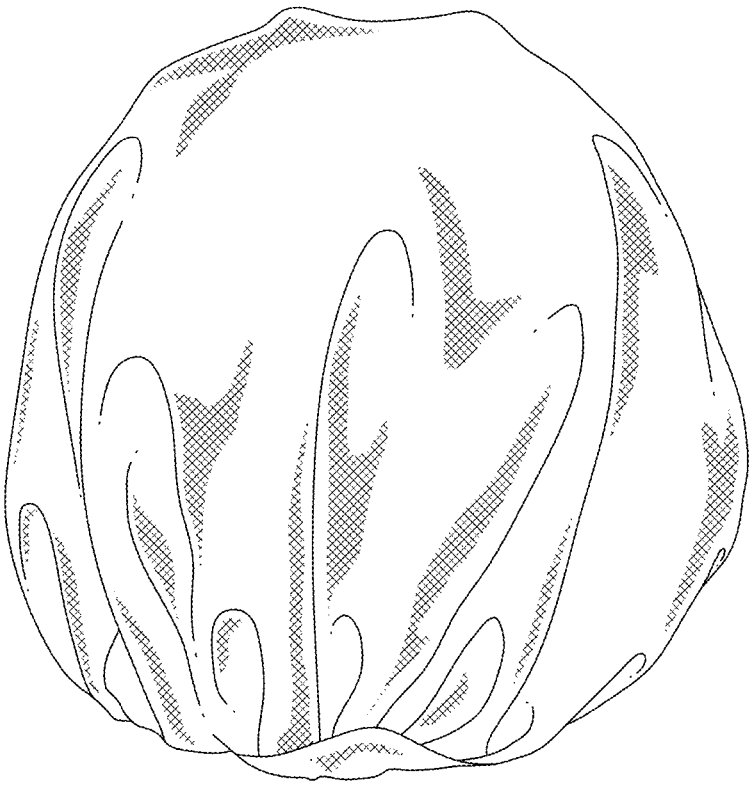
FIG. 3 is a rear view of the present invention.
Figure 4:
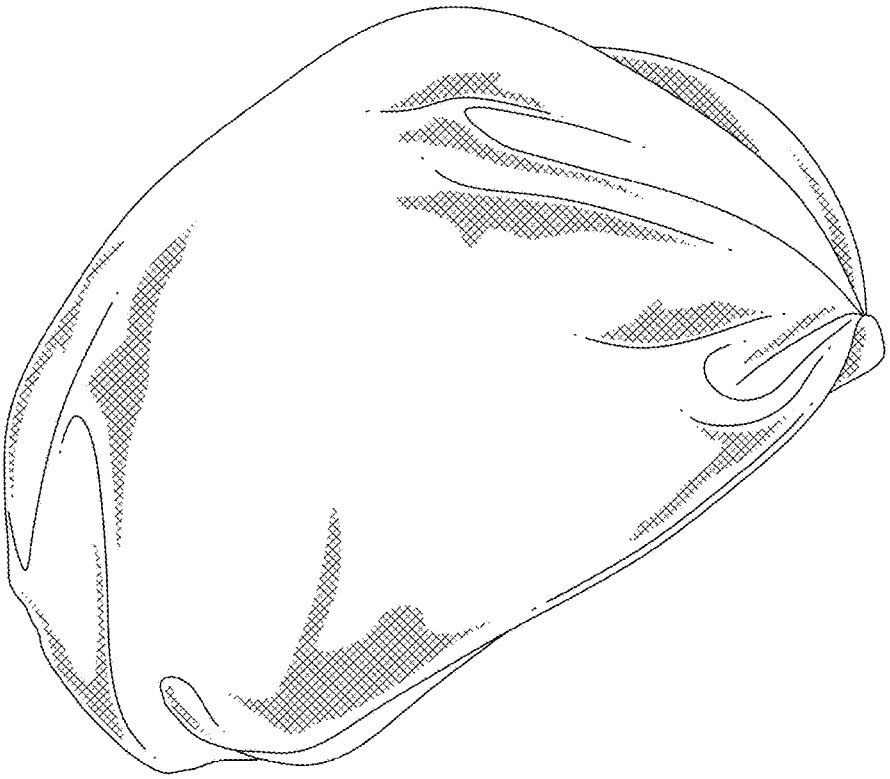
FIG. 4 is a right side view of the present invention.
Figure 5:
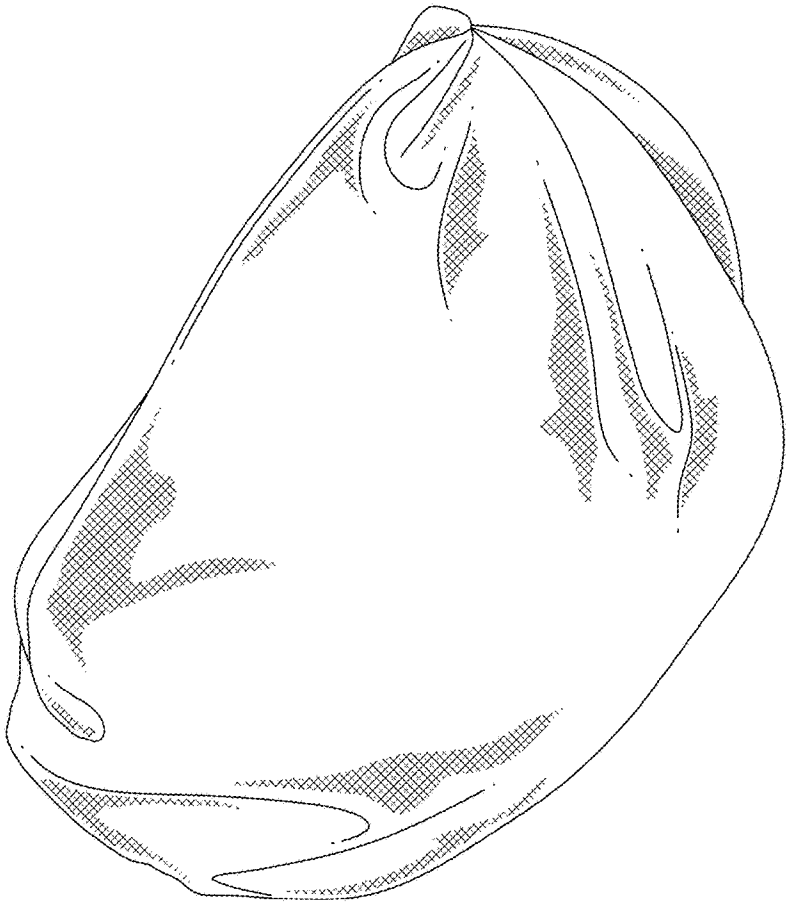
FIG. 5 is a left side view of the present invention.
Figure 6:
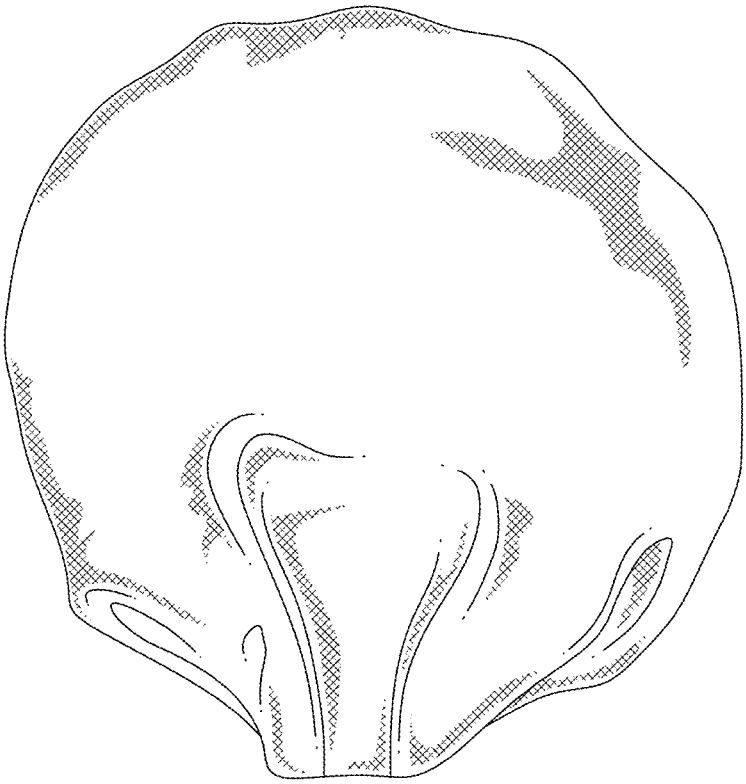
FIG. 6 is a top view of the present invention.
Figure 7:
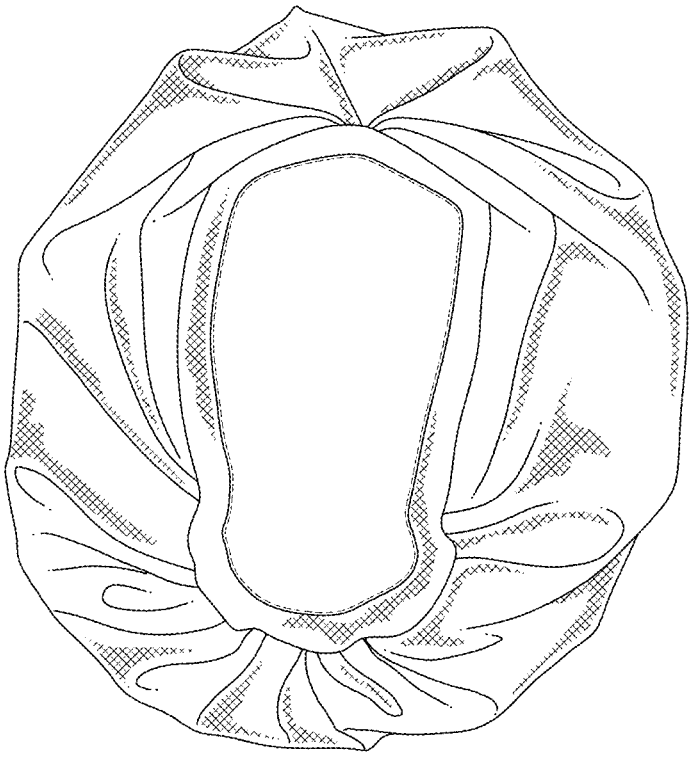
FIG. 7 is a bottom view of the present invention.
Figure 8:
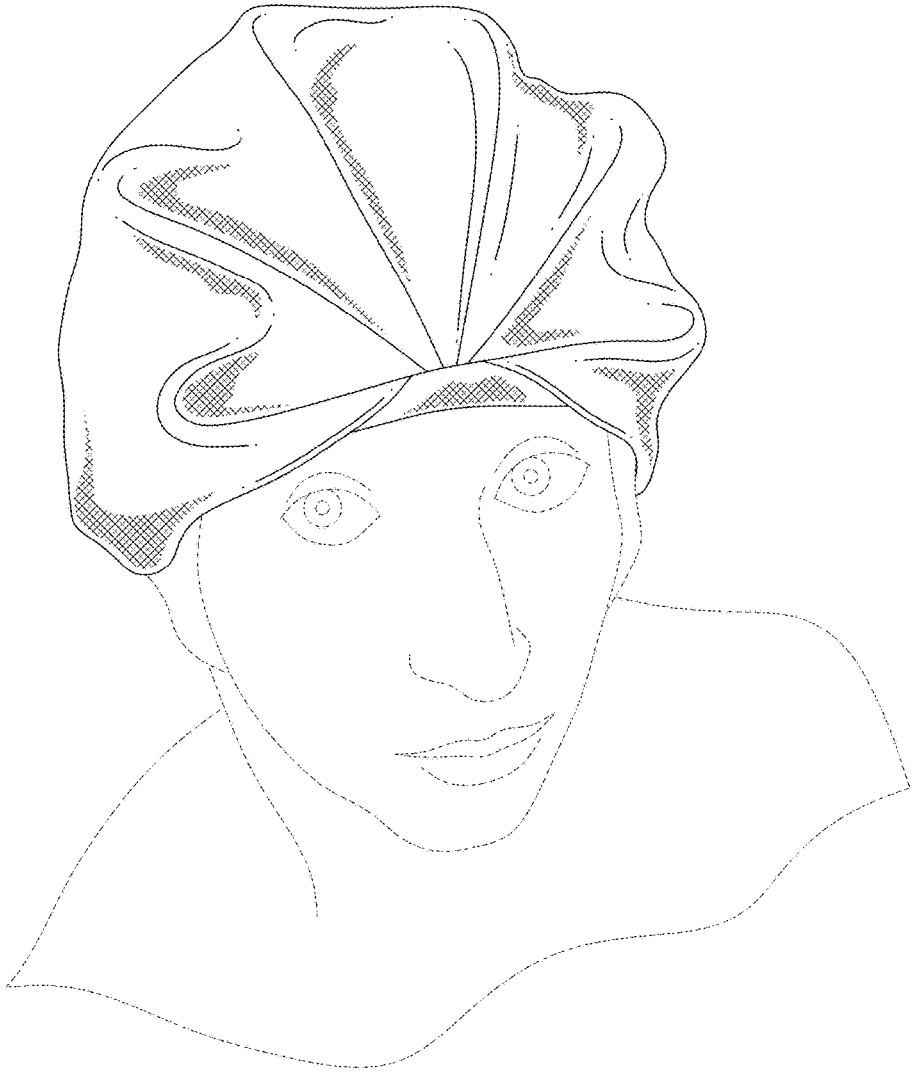
FIG. 8 is a perspective view of the present invention as worn by an individual in accordance with the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

While this disclosure refers to exemplary embodiments, it will be understood by those skilled in the art that various changes may be made and equivalents may be substituted for elements thereof without departing from the scope of the disclosure. In addition, many modifications will be appreciated by those skilled in the art to adapt a particular instrument, situation or material to the teachings of the disclosure without departing from the spirit thereof. Therefore, it is intended that the disclosure not be limited to the particular embodiments disclosed.

Referring to FIG. 1, an embodiment of the present invention is shown. Here, shower cap 100 is shaped similarly to a turban, in that it provides complete coverage of the hair-producing areas of a user's scalp. In addition to the unique shape of the shower cap 100, shower cap 100 features a back pocket. That is, shower cap 100 is equipped with an additional amount of fabric, breaking from the standard contours of shower cap 100. This additional fabric allows for users with large amounts of hair, or with unique hairstyles to still avail themselves of the benefits of the present invention.

In a preferred embodiments, shower cap 100 is comprised of a material that is water-repellent. In another preferred embodiment, this material is fabric. While many suitable fabrics exist, the ideal fabric will be one that is antimicrobial and water resistant. While a fabric that is coated with an antimicrobial agent is suitable, one that is inherently antimicrobial, such as fabrics that contain aluminum or tin are preferable, as their antimicrobial properties will not fade with time. Natural and synthetic latex are a particularly suitable materials for this purpose. This makes the fabric hydrophobic and has a nanotechnology component.

In yet another preferred embodiment, the present invention is a dual-layer variant wherein said inner layer is constructed out of polyurethane, and the outer layer is constructed out of a material that is coated with durable water repellant coating. The resulting fabric appears to be one layer to the consumer. There are many proprietary suitable durable water repellants, sold by vendors such as Grangers, Nikwas, McNett, Trek7. Alternatively, a single fabric variant can be used, where the durable water repellant coating is disposed directly on the knit or woven face of the fabric. Preferably, the fabric will be breathable so that the user wearing the covering apparatus does not get too hot or a humid environment is not created and thus acts to prevent hair frizz. In an alternative embodiment, shower cap 100 is machine washable. In yet another alternative embodiment, shower cap 100 is disposable.

Shower cap 100 has auditory dampening effects. Standard plastic shower caps, when in use, create sound with a volume of 84 decibels (dB) on average, reaching as high as 90 dB. In contrast, shower cap 100 creates sound with a volume of 82 dB on average, and only gets as high as 85 dB. Plastic shower caps create snapping loud sounds whereas the present invention creates a more soothing type of noise which creates a more relaxing experience for those wearing the covering apparatus.

FIGS. 2-8 show the same embodiment of the present invention as FIG. 1, and therefore contain the same features disclosed therein.

Figure 9:
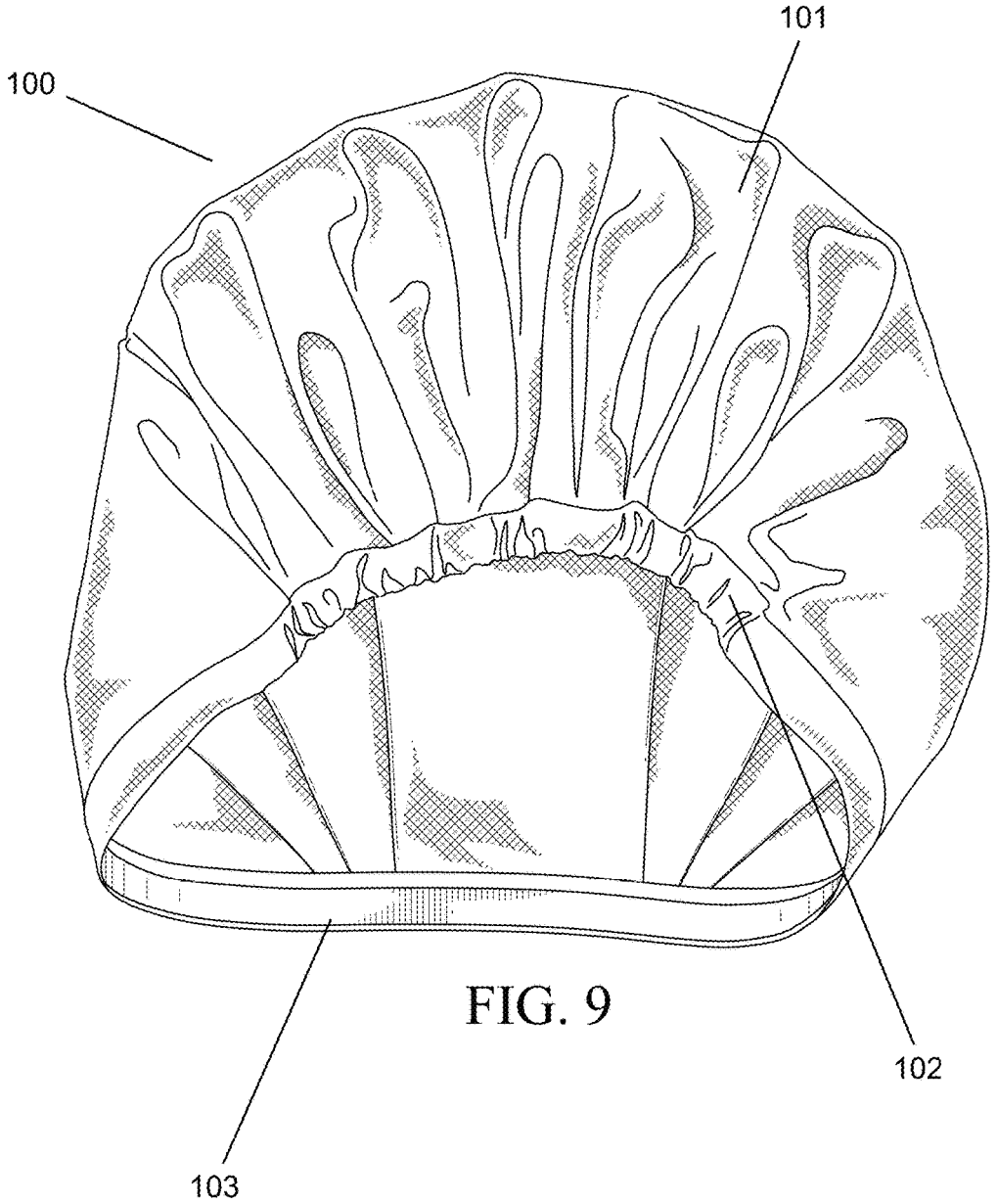
FIG. 9 is an alternative view of the present invention.

Referring to FIG. 9, a front view of an embodiment of the present invention is shown. Here, shower cap 100 features outer layer 101, gathered band 102, and elongated band 103. In one embodiment, gathered band 102 and elongated band 103 are of a unitary construction. Preferably, gathered band 102 and elongated band 103 are constructed out of an elastic material. This allows shower cap 100 to be snugly attached to a user's head. This prevent accidental slip-offs, which is important, because if a user's hair is subjected to water while using the cap, the purpose of using the present invention is largely defeated. Further, outer layer 101 may have ornamentation disposed thereon. That is, various patterns or images may be printed on the outer layer 101. In some embodiments, this ornamentation is disposed prior to the application of the durable water repellant, and in other embodiments, the ornamentation is disposed after the application of the durable water repellant. Preferably, outer layer 101 is comprised of a material that stretches, providing the user with greater comfort while using shower cap 100. In another embodiment, the material does not have to be stretchable.

Figure 10:
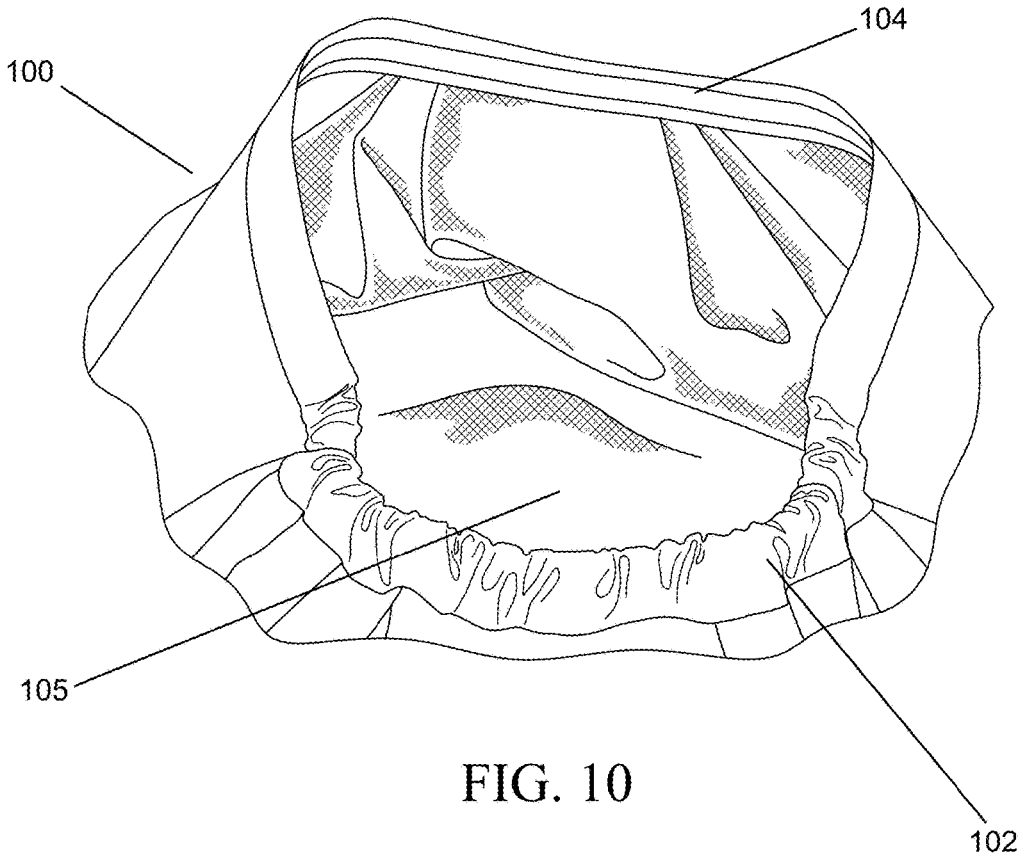
FIG. 10 is an alternative view showing the inside of the present invention.

In FIG. 10, another view of an embodiment of shower cap 100 is provided for. Here, shower cap 100 features grip 104, gathered band 102, and inner layer 105. It should be noted that while preferable, the inclusion of grip 104 is purely optional. Preferably, grip 104 is constructed out of rubber. In another embodiment, the grip can be made from any material, such as fabric or neoprene such that the grip can provide a water sealing effect while providing a mechanism for non-slippage. Inner layer 105 can be constructed out of any fabric, but something stretchable is desired, particularly if the two-layer variant is being utilized. Inner layer 105 may also be disposed with ornamentation such as patterns or illustrations.

In some embodiments, the gathered band 102 is thicker, so that a snugger grip may be achieved. In one embodiment, inner layer 105 is disposed with dry shampoo or a scented agent. This will enable a user's hair to be refreshed while using shower cap 100.

Figure 11:
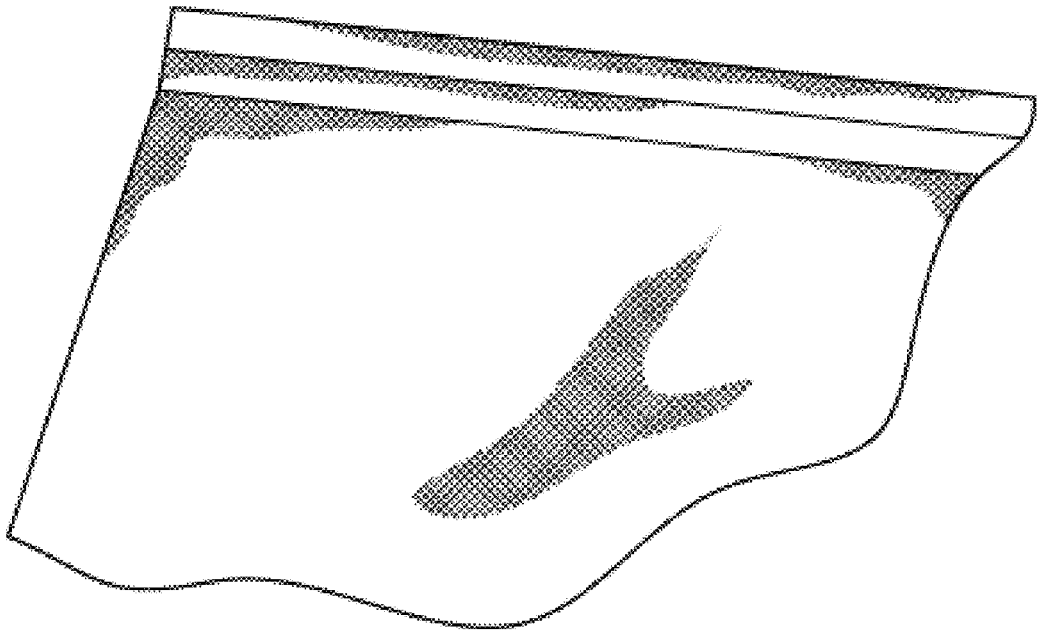
FIG. 11 shows a perspective view of the fabric pre fold of the present invention.
Figure 12:
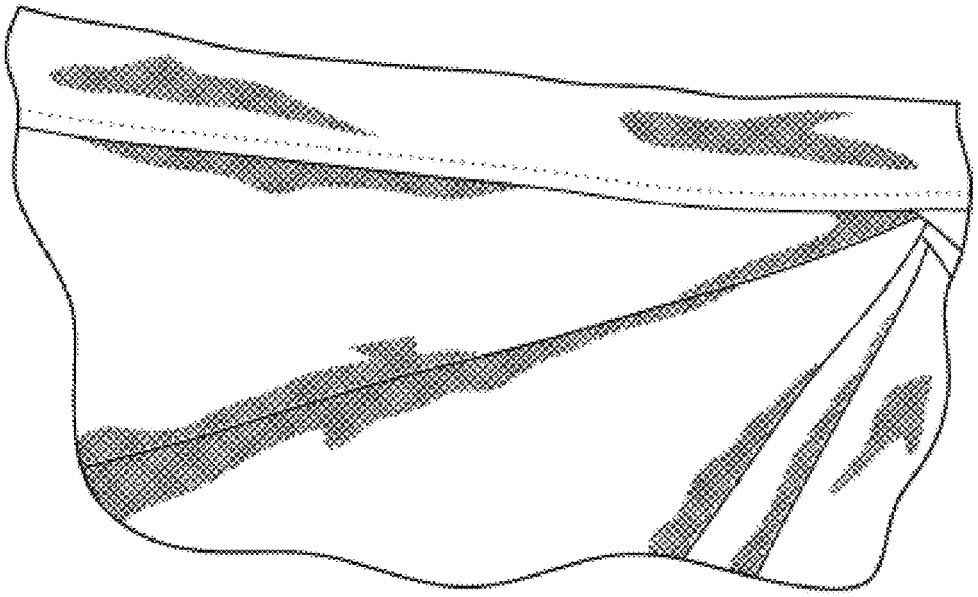
FIG. 12 shows a perspective view of the fabric post fold of the present invention

FIGS. 11 and 12 show two embodiments of attachments of the two-layer variants. FIG. 11 shows an embodiment where the two layers are adhered together. FIG. 12 shows an embodiment where the two layers are folded over one another and subsequently joined.

Figure 13:
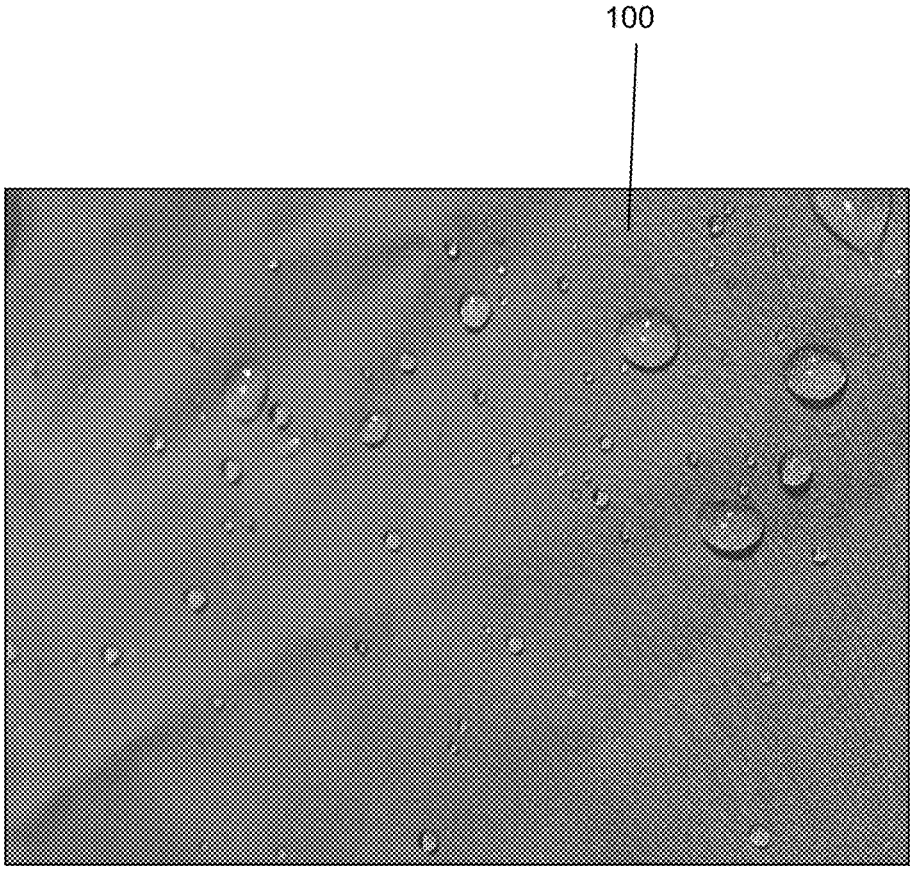
FIG. 13 shows an illustrative view of the water resistant fabric of the present invention.

In FIG. 13, the water-repellant nature of shower cap 100 is shown.

In yet another embodiment, the present invention is equipped with a drawstring so that it may double as a makeup bag for travel.

When introducing elements of the present disclosure or the embodiment(s) thereof, the articles "a," "an," and "the" are intended to mean that there are one or more of the elements. Similarly, the adjective "another," when used to introduce an element, is intended to mean one or more elements. The terms "including" and "having" are intended to be inclusive such that there may be additional elements other than the listed elements.

Therefore, it is intended that the disclosure not be limited to the particular embodiments disclosed.

What is claimed is:

1. A covering apparatus comprising:
a unitary material;
a grip;
an elastic member;
a gathered band; and
an elongated band;
wherein the gathered band and the elongated band are of a unitary construction;
wherein the gather band and the elongated band are attached to a periphery of the covering apparatus;
wherein the elastic member is enclosed within the gathered band;
wherein the unitary material comprises an outer layer and an inner layer;
wherein the outer layer comprises a fabric;
wherein the outer layer is water repellent;
wherein the inner layer is polyurethane;
wherein the covering apparatus comprises a plurality of folds;
wherein the plurality of folds culminate in a point at a front of the covering apparatus above the elongated band;
wherein the elastic member is located at a rear of the covering apparatus;
and wherein the covering apparatus is a shower cap.

2. The covering apparatus of claim 1, wherein the unitary material comprises a plurality of digitally sublimated designs.

3. The covering apparatus of claim 1, wherein the grip is stitched, bonded or piped to an inner portion of the covering apparatus.

4. The covering apparatus of claim 1 wherein the covering apparatus further comprises a plastic liner disposed on an inner portion of the covering apparatus.

5. The covering apparatus of claim 1, wherein the covering apparatus is knit or woven.

6. The covering apparatus of claim 1, wherein the fabric is at least one of antimicrobial or breathable.

7. The shower cap of claim 1, wherein the grip comprises at least one of rubber, fabric, or neoprene.

* * * * *